US007188792B2

(12) United States Patent
Chase, Jr.

(10) Patent No.: US 7,188,792 B2
(45) Date of Patent: Mar. 13, 2007

(54) REFINER ROTOR ASSEMBLY WITH A HUB HAVING FLOW-THROUGH PORTS

(75) Inventor: Calvin C. Chase, Jr., Dunstable, MA (US)

(73) Assignee: GL&V Management Hungary Kft., Budapest (HU)

( * ) Notice: Subject to any disclaimer, the term of this patent is extended or adjusted under 35 U.S.C. 154(b) by 18 days.

(21) Appl. No.: 10/392,478

(22) Filed: Mar. 18, 2003

(65) Prior Publication Data

US 2004/0182959 A1 Sep. 23, 2004

(51) Int. Cl.
*B02C 7/06* (2006.01)
*B02C 7/12* (2006.01)
*B02C 7/02* (2006.01)

(52) U.S. Cl. ..... 241/261.2; 241/248; 241/261.1; 241/261.3

(58) Field of Classification Search ..... 241/261.2, 241/261.3, 297, 298, 261.1
See application file for complete search history.

(56) References Cited

U.S. PATENT DOCUMENTS 3,708,130 A 1/1973 Perry ..... 241/260
3,984,057 A * 10/1976 Pilao ..... 241/248
4,032,267 A 6/1977 Miller ..... 418/61 B
4,036,443 A 7/1977 Saltarelli ..... 241/297
4,269,365 A 5/1981 Berggren ..... 241/152 A
4,529,137 A 7/1985 Matthew ..... 241/163
4,600,475 A 7/1986 Reinhall ..... 162/261
4,783,014 A * 11/1988 Fredriksson et al. ..... 241/261.2
5,176,793 A 1/1993 Kurtz ..... 162/4
5,178,339 A * 1/1993 Pilao ..... 241/298
5,445,328 A 8/1995 Musselman ..... 241/37
5,707,016 A * 1/1998 Witsken ..... 241/46.06
5,762,275 A * 6/1998 Aikawa ..... 241/261.2
5,823,453 A 10/1998 Garasimowicz ..... 241/261.3
5,934,585 A * 8/1999 Chaney ..... 241/298
6,053,440 A 4/2000 LaRivierre ..... 241/46.01
6,250,573 B1 6/2001 Kriebel ..... 241/17

* cited by examiner

*Primary Examiner*—Derris H. Banks
*Assistant Examiner*—Jason Y. Pahng
(74) *Attorney, Agent, or Firm*—James Earl Lowe, Jr.

(57) ABSTRACT

A refiner including a material-admitting inlet and an outlet; and spaced apart first and second refining discs mounted in the chamber. The refiner further includes a rotary third ref refining disc disposed between the first and second discs. A first path for the movement of material from the inlet is defined between the first and third refining disks. A second path for the movement of material to the outlet is defined between the second and third refining disks. The refiner further includes a shaft extending through a central opening provided in the first disc, and a hub rigid with the shaft and having a center, the hub being received in the third refining disc central opening. The hub has at least one port in the hub from the first path to the second path and between the third refining disc central opening and the center of the hub.

12 Claims, 7 Drawing Sheets

REFINER ROTOR ASSEMBLY WITH A HUB HAVING FLOW-THROUGH PORTS

BACKGROUND OF THE INVENTION

The present invention relates to refiners for wood pulp or the like, and more particularly to improvements in refiners wherein stationary refining plates flank rotary refining plates in the chamber of a housing whose inlet admits stock for treatment by comminuting projections (e.g., ribs) on the neighboring surfaces of stationary refining plates and rotary refining plates.

It is already known to utilize in a disc or rotor refiner two coaxial or eccentric plates or discs each of which is driven by a discrete prime mover and which have neighboring surfaces provided with ribs or otherwise configured projections which comminute the material to be treated while the material advances from the inlet toward the outlet of the stock chamber.

It is further known to use a pair of discs one of which is stationary and the other of which rotates relative to the stationary disc.

It is also known to dispose two rotary discs between two stationary discs so that each rotary disc cooperates with a different stationary disc. The rotary discs are mounted at the opposite sides of a disc-shaped carrier which is driven by a shaft. The stock is fed through one of the stationary discs to enter the space between the one stationary disc and the respective rotary disc, and some of the stock is allowed to pass through relatively small openings in the rotary discs to enter the space between the other rotary disc and the other stationary disc.

SUMMARY OF THE INVENTION

An object of the invention is to provide a novel and improved refiner for pulp or other types of fibrous stock used in paper making and related industries.

An additional object of the invention is to provide a refiner wherein a single rotary refining member can cooperate with stationary refining members and wherein the wear upon all refining members is essentially the same.

Still another object of the invention is to provide the improved refiner with novel means for insuring uniform distribution of stock to be treated among several discrete paths along which the stock advances from the inlet toward the outlet of the stock chamber.

A further object of the invention is to provide a novel and improved rotary refining member and hub for use in the above outlined refiner.

Another object of the invention is to provide greater hub spline pitch diameter with an increased number of teeth and reduced hub spline tooth contact forces.

Another object of the invention is to provide reduced hub spline stress in the teeth and reduced hub spline wear.

Another object of the invention is to provide an increase in refiner service life and to provide a refiner with cross flow areas that are equal to or exceed the conventional porting.

Another object of the invention is to provide a refiner with reduced flow loss due to line friction and to provide a refiner with reduced flow loss due to entrance friction.

Another object of the invention is to provide a refiner with improved pressure load balance between inner and outer sets of refiner plates.

Another object of the invention is to provide a refiner with increased pressure gradient between the sides of the rotating discs or plates that will aid flow through the stock flow portholes.

The invention further comprises a refiner for pulp or like materials, comprising a housing having a chamber, a material-admitting inlet and an outlet; and spaced apart first and second refining discs mounted in the chamber. The refiner further includes a rotary third refining disc disposed in the chamber between the first and second discs and defining therewith first and second paths for the movement of material from the inlet to the outlet. The third refining disc has a central opening, and the discs are coaxial with each other. The first and second discs respectively also have first and second comminuting projections adjacent to the first and second path and the third disc has third and fourth comminuting projections adjacent to the first and second path and respectively cooperating with the first and second projections to refine the material flowing along the first and second paths. The refiner further includes a mechanism for rotating the third refining disc and comprising a shaft extending through a central opening provided in the first disc, and a hub rigid with the shaft and having a center, the hub being received in the third refining disc central opening. The hub has at least one port in the hub from the first path to the second path and between the third refining disc central opening and the center of the hub. This configuration reduces tooth stress on the spline, reduces flow restrictions for the passage of stock through the assembly, and increases uniformity of loading on both sets of refiner plates.

Figure 1:
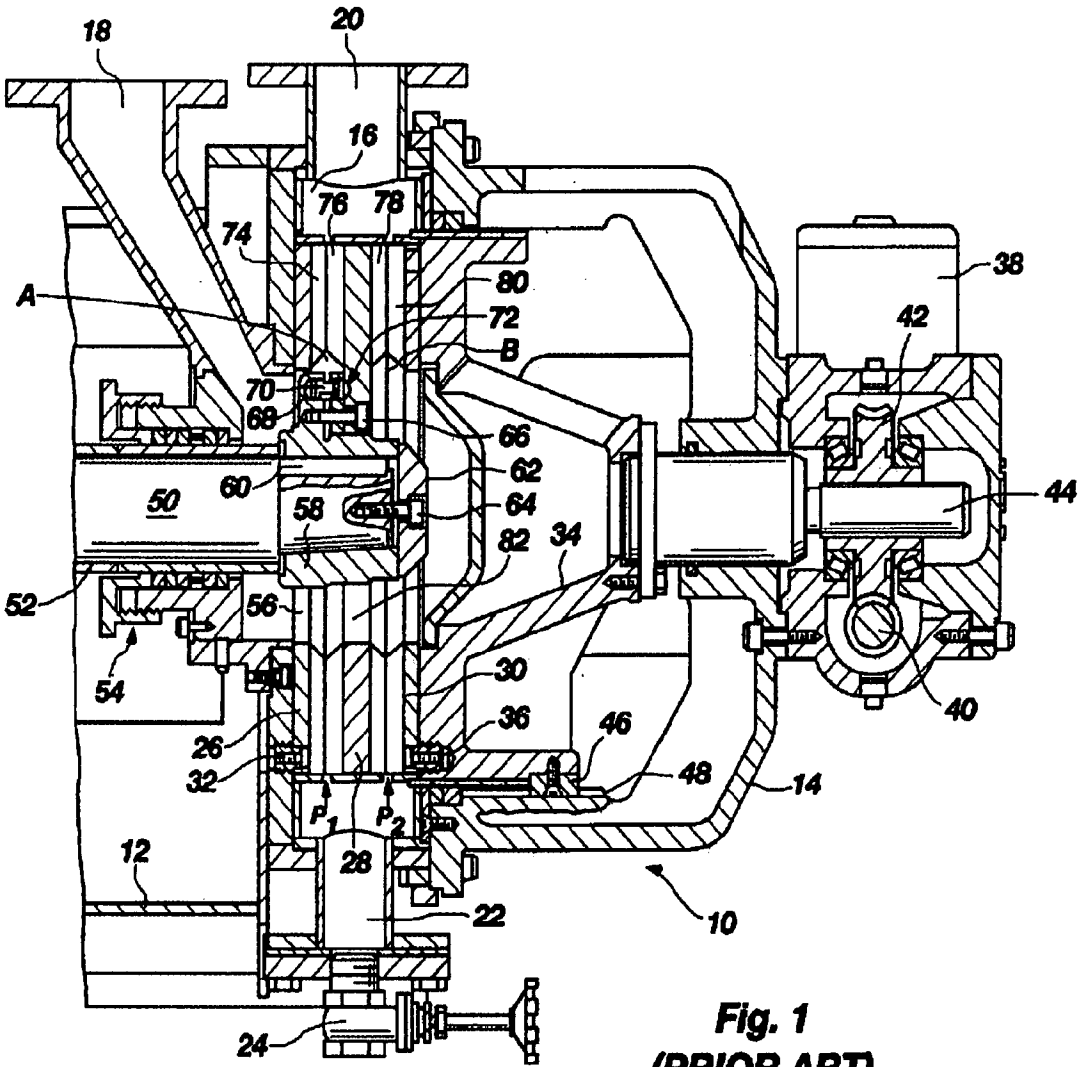
Fig. 1 (PRIOR ART)
FIG. 1 is a fragmentary longitudinal vertical sectional view of a prior art refiner.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENTS

Elements in Common with the Prior Art

Referring first to FIG. 1, there is shown a prior art disc refiner having a housing 10 including several bolted-together sections two of which are shown at 12 and 14. The description of FIGS. 1 through 5 comes from one such prior art construction, as shown in Pilas U.S. Pat. No. 3,984,057. The housing defines a stock chamber 16 and has an inlet 18 for admission of pulp, e.g., from the outlet of a pump, a first outlet 20 for evacuation of refined pulp, at least in part under the action of centrifugal force, and a second outlet 22 which is normally closed by a suitable valve 24. The outlet 20 extends upwardly and the outlet 22 extends downwardly; the valve 24 is opened when the attendants wish to drain the liquid carrier for wood chips or the like from the chamber 16.

The chamber 16 accommodates three refining members 26, 28, 30 here shown as coaxial discs having identical outer diameters. In other embodiments (not shown), two back to back discs can be used instead of the single disc 28. In still other embodiments (not shown), additional disc sets can be used. In still other embodiments (not shown), the refining members may constitute cones or other types of refining members.

The disc 26 is stationary and is fixedly secured to the housing section 12 by screws 32 or analogous fasteners. The disc 30 does not rotate. This disc is spaced apart from the disc 26 and is secured to an axially movable support 34 by means of screws 36 or the like. The support 34 is mounted in the housing section 14 and is movable axially of the discs 26, 28 by a reversible electric motor 38 which can drive a worm 40. The latter meshes with a worm wheel 42 having internal threads in mesh with external threads at the right-hand end of a spindle 44 which is rigid with the support 34. The support 34 has one or more radial projections or followers 46 slidable in elongated grooves 48 of the housing section 14. The grooves 48 are parallel to the common axis of the discs 26, 28 and 30. In other embodiments, other mechanisms for supporting the disc 30 can be used.

The disc 28 is rotatable relative to and is movable axially between the discs 26 and 30. The means for rotating the disc 28 comprises a drive shaft 50 which rotates in a sleeve 52 mounted in the housing section 12. The sleeve 52 is surrounded by a stuffing box 54 which prevents the escape of pulp from the chamber 16 into the left-hand portion of the housing section 12. That end portion of the shaft 50 which extends from the housing section 12 preferably carries a pulley or sprocket wheel driven by an electric motor or another suitable prime mover through the medium of an endless belt or chain. Other types of transmissions between the prime mover and the shaft 50 can be used with equal advantage.

The disc 26 has a relatively large central opening 56 which communicates with the inlet 18 and surrounds the shaft 50 with a substantial amount of clearance. That end portion of the shaft 50 which extends beyond the opening 56 and into the central part of the chamber 16 carries a hub 58 which is secured thereto by a key 60, a cap 62 and a screw 64 so that the hub 58 shares all angular movements of the shaft 50. The hub 58 transmits torque to the centrally located disc 28 by way of several screws 66 but the disc 28 has limited freedom of axial movement relative to the hubs 58 and screws 66. The hub is provided with an eccentric blind bore 68 for a guide pin 70 a portion of which extends into an aligned blind bore 72 of the disc 28. It can be said that the disc 28 "floats" between the discs 26, 30 and automatically finds a central position between the stationary discs 26, 30, not only in response to wear on the surfaces of comminuting projections on the discs but also upon axial adjustment of the disc 30.

Figure 2:
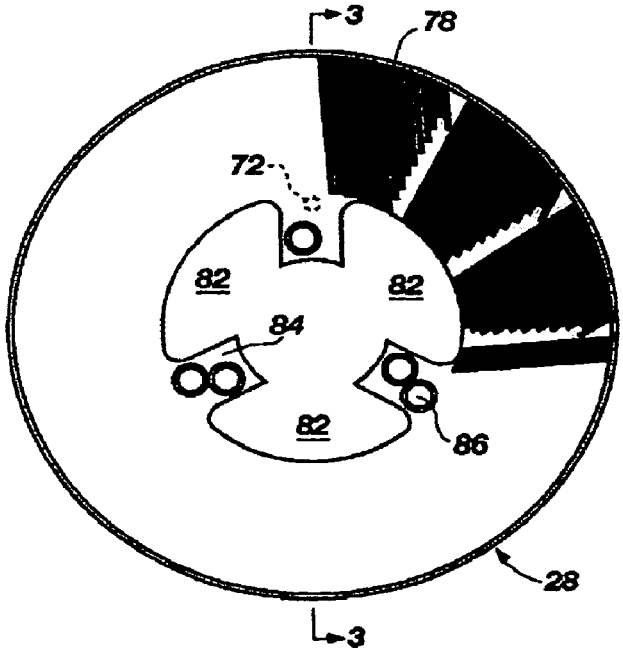
Fig. 2 (PRIOR ART)
FIG. 2 is a side elevational view of a rotary refining member in the refiner of FIG. 1.
Figure 3:
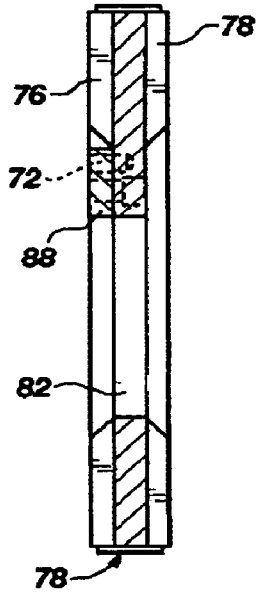
Fig. 3 (PRIOR ART)
FIG. 3 is an axial sectional view as seen in the direction of arrows from the line 3—3 of FIG. 2.

The discs 26, 28 and 28, 30 respectively define first and second paths A and B along which the pulp can advance from the inlet 18 toward the first outlet 20 (the second outlet 22 is assumed to be sealed when the refiner is in use). The path A is flanked by rib-shaped comminuting projections 74, 76 of the discs 26, 28, and the path B is flanked by rib-shaped comminuting projections 78, 80 of the discs 28, 30. The opening 56 of the disc 26 admits pulp from the inlet 18 into the central portion of the first path A, and such pulp flows radially outwardly between the projections 74, 76 toward the outlet 20. The central portion of the disc 28, as shown in FIG. 2, has three kidney-shaped openings 82 whose combined cross-sectional area is less than the effective area of the opening 56. The openings 82 connect the path A with the path B so that some of the pulp which is admitted via opening 56 flows through the openings 82 and into the path B to be comminuted by the projections 78, 80 on its way toward the outlet 20. The openings 82 are partially separated from each other by radially inwardly extending portions 84 one of which has the blind bore 72 and each of which has one or more untapped bores 86 for the respective screws 66.

Figure 4:
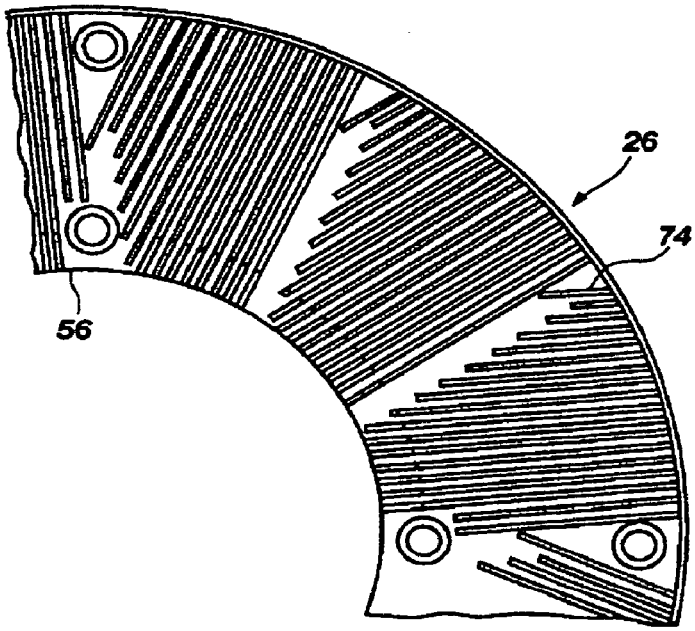
Fig. 4 (PRIOR ART)
FIG. 4 is a fragmentary elevational view of a first refining member in the refiner of FIG. 1.

FIG. 4 shows a portion of the disc 26 which may be identical with the disc 30. The diameter of the opening 56 in the disc 26 is one-half the outer diameter of this disc. The effective area of the opening 56 is that area of this opening which surrounds the corresponding portion of the shaft 50. The combined effective area of the openings 82 in the disc 28 is smaller than the effective area of the opening 56 because the disc 28 receives the hub 58 and also because this disc is formed with the portions 84. However, the combined effective area of the openings 82 is large enough to insure that the quantity of pulp which flows from the openings 82 into the path B is identical or practically identical with the quantity of pulp flowing from the opening 56 into the path A.

Figure 5:
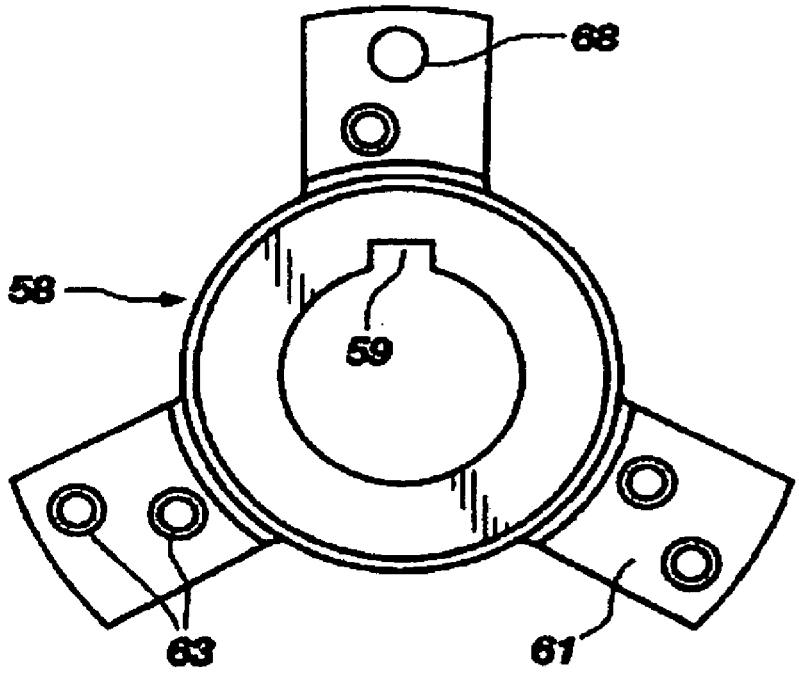
Fig. 5 (PRIOR ART)
FIG. 5 is an elevational view of a hub which forms part of the means for rotating the third refining member in the refiner of FIG. 1.

FIG. 5 shows the prior art hub 58. This hub has a keyway 59 for the key 60 and three radially outwardly extending arms 61 which overlie and are secured to the portions 84 of the disc 28. One of the arms 61 has the bore 68 for a portion of the guide pin 70 and each arm has at least one tapped bore 63 for the stem of the respective screw 66.

In another embodiment (not shown), the outside diameter of the prior art hub is splined and is of a diameter that is calculated to be of adequate strength while staying inside the cross head porting required to supply stock to the second path B. The hub is held in place on the shaft with the cap 62 and screw 64, centered on the end of the shaft 50. The cap 62 may be of a diameter to also retain the disc 28 from coming off the end of the splined hub.

Figure 6:
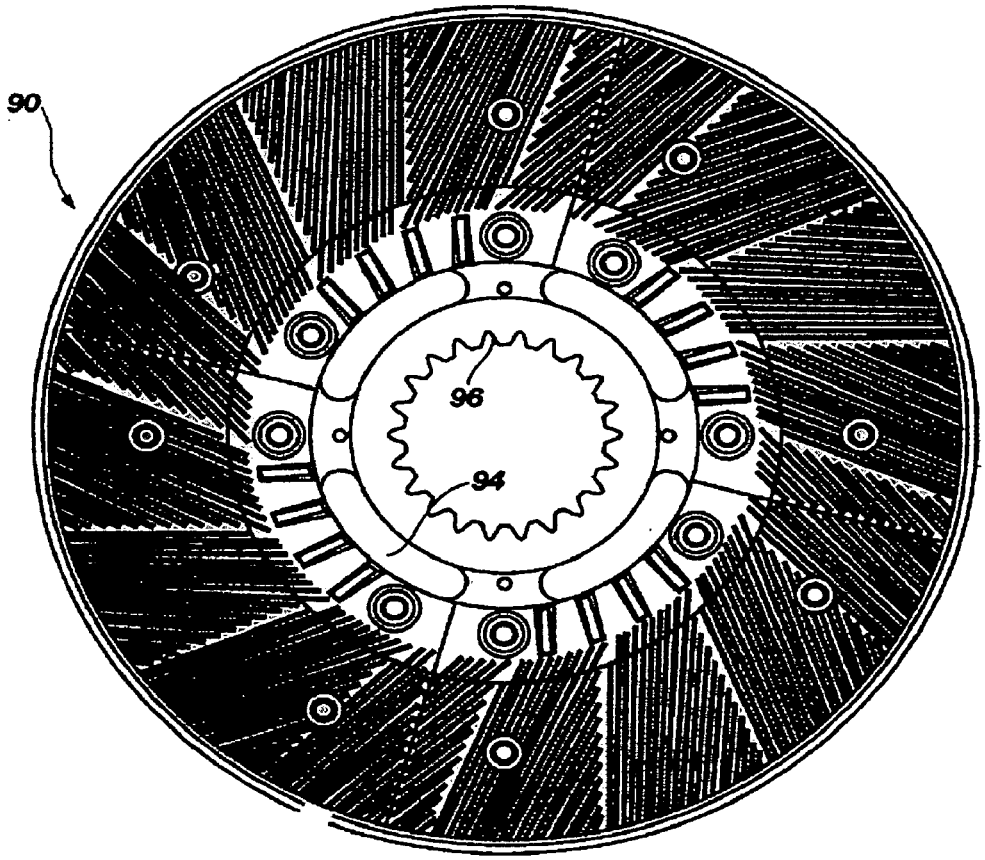
Fig. 6 (PRIOR ART)
FIG. 6 is a side elevational view of another embodiment of the prior art refining member shown in FIG. 2.

As shown in FIG. 6, another prior art rotating disc 90 is a large, round flat plate, usually with retaining lips on the outside diameter of both sides of the disc 90, to aid in positioning and retaining the discs 26 and 30. The disc 90 is designed to be positioned between the two stationary discs 26 and 30 and to be driven by the splined hub described above. The disc 90 has cross flow porting 94 located between the spline 96 that engages the hub spline and the inner diameter of the disc 90.

The cross flow porting port holes 94 are usually limited in size due to the requirements for hoop stress for the spline 96 and tortional loading through the area between the ports 94.

The Hub and Disc of this Invention

Figure 7:
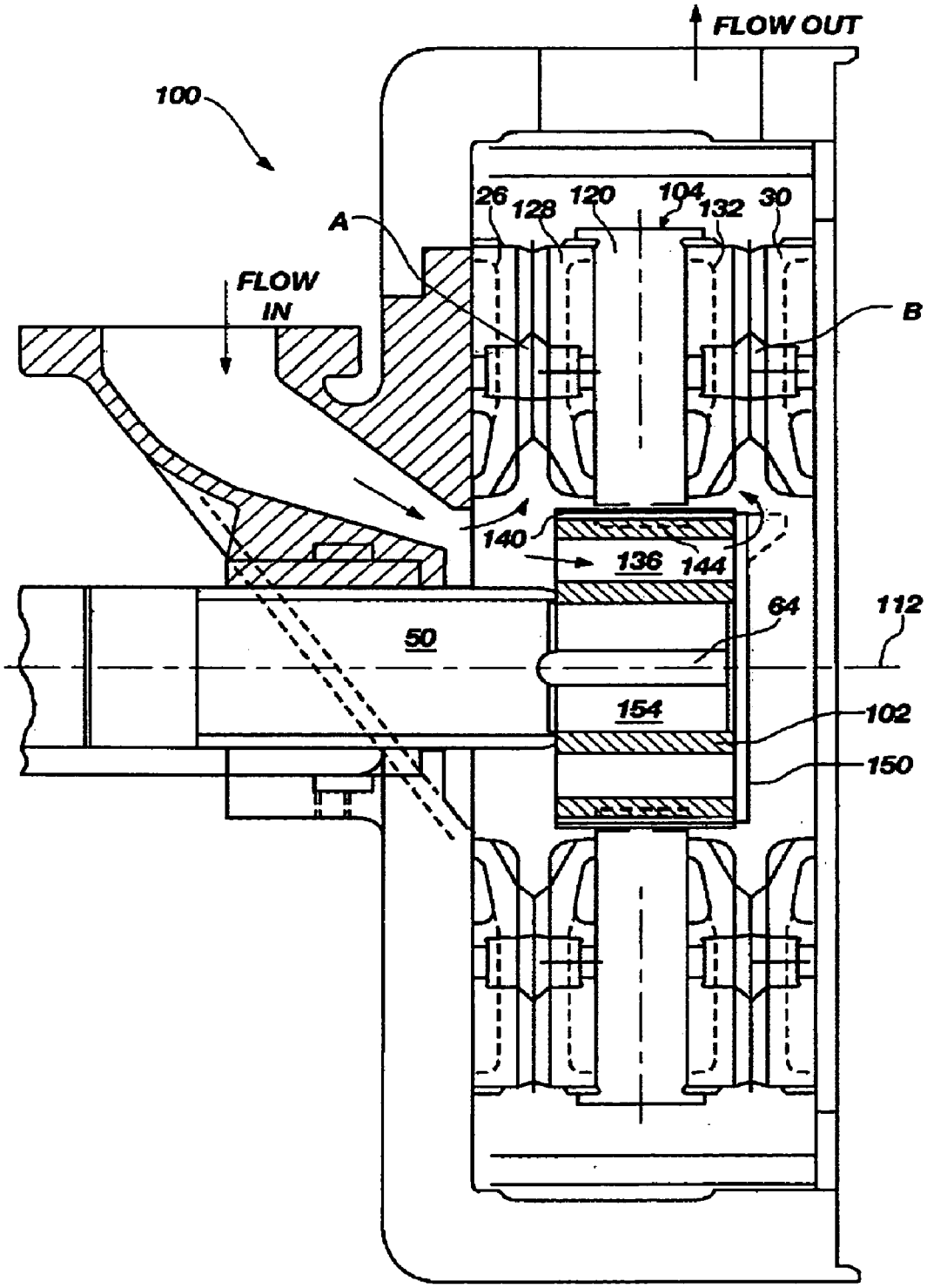
FIG. 7 is a fragmentary partly longitudinal vertical sectional view of a refiner with a hub and disc forming a rotary refining member in accordance with this invention.

FIG. 7 shows a refiner 100 with a hub 102 and disc 104 forming a rotary refining member in accordance with this invention. More particularly, the refiner, except for the hub 102, disc 104 and cap 150, is essentially the same as that shown in FIG. 1.

Figure 8:
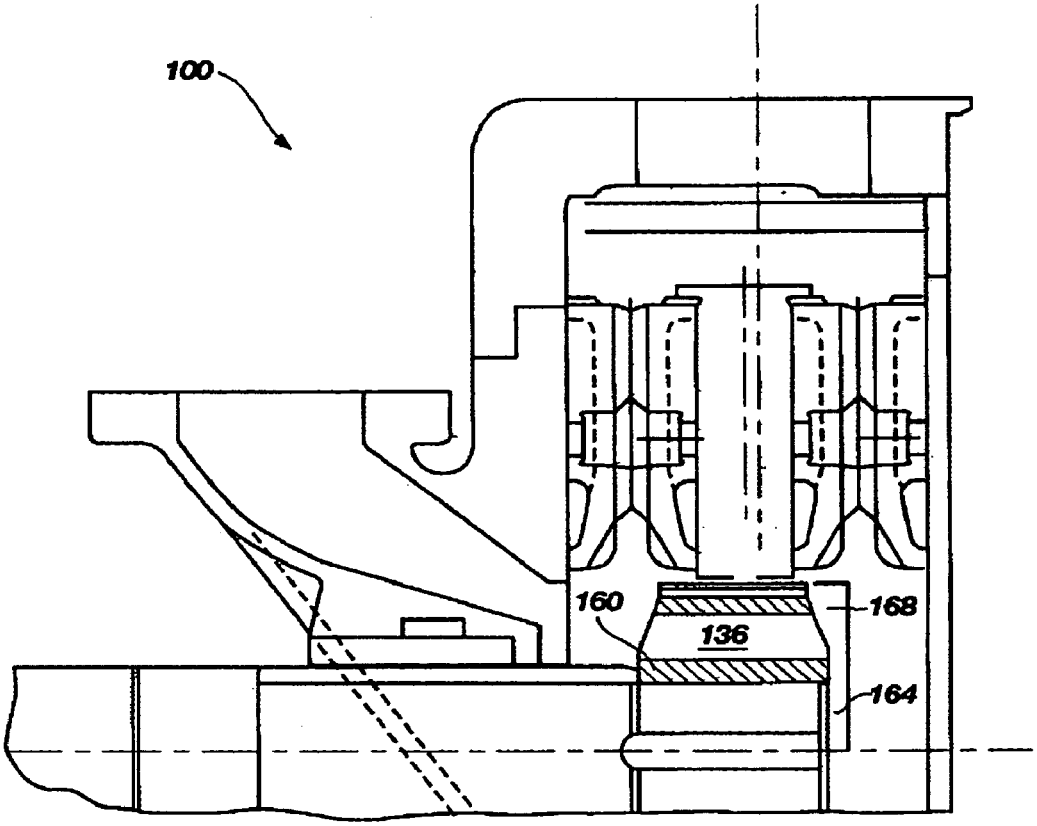
FIG. 8 is a fragmentary partly longitudinal vertical sectional view similar to FIG. 7, only showing an alternate hub and end plate construction.
Figure 9:
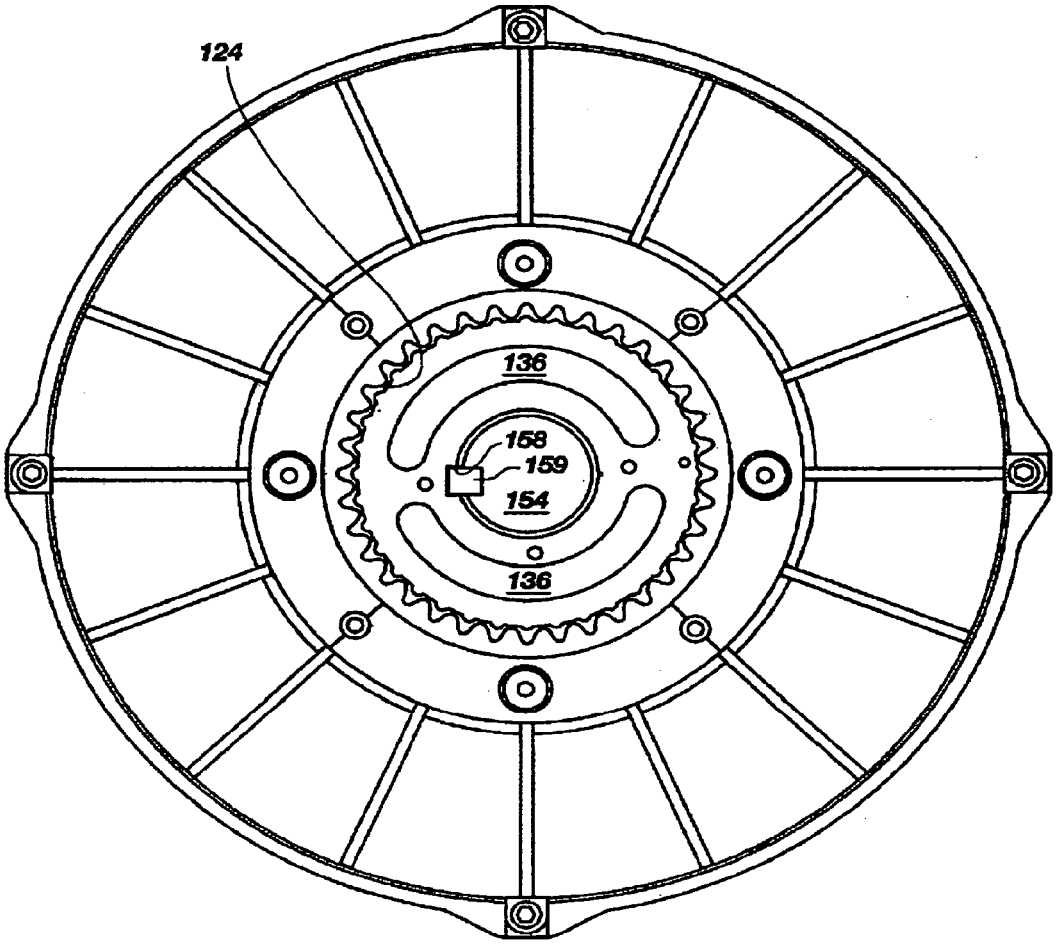
FIG. 9 is a side elevational view of the hub and rotary refining member shown in FIGS. 7 and 8.

More particularly, as shown in FIGS. 7, 8 and 9, the hub 102 is rigid with the drive shaft 50 and has a center 112 and a splined exterior 140. Still more particularly, as shown in FIG. 9, the hub 102 has a conventional standard round bore 154 with a keyway 158 for an industry standard keyway 159. The outside of the hub 102 is larger than conventional splined hubs, and the hub 102 is only slightly smaller than the inside diameter of a standard refiner plate for any given size. This larger spline diameter produces many more teeth than standard splined hubs that must stay inside the portholes 94 (as shown in FIG. 6) for through flow rotating heads. The hub 102 greater spline pitch diameter with the increased number of teeth reduces the tooth contact forces thus reducing stress in the teeth and reducing wear, thus increasing refiner 100 service life.

The hub 102 is received in the third refining disc central opening 124, and the hub 102 has at least one port 136 in the hub 102 from the first path A to the second path B and between the third refining disc central opening 124 and the center 112 of the hub 102. In the preferred embodiment, the hub 102 has two ports 136, as shown in FIG. 9. The refiner 100 further includes means for transmitting torque from the hub 102 to the third disc 104, the torque transmitting means comprising splines 140 on the hub outer surface, and the third refining disc central opening 124 having splines 144 that engage the hub splines 140. The hub splines 140 and third disc splines 144 permit the third disc 104 to move axially along the hub 102. In other embodiments, other means for connecting the hub 102 to the disc 104 may be used.

In the preferred embodiment, the third refining or rotary disc 104 comprises a central disc-shaped carrier or support 120 having a central opening 124, and a first plate 128 secured by screws on one side of the central support 120 and a second plate 132 secured by screws on the opposite side of the central support 120. Since the cross flow ports are now located within the hub 102, the third disc 104 does not have cross flow ports. In less preferred embodiments (not shown), however, some cross flow ports could be provided in the third disc 104.

In the preferred embodiment as shown in FIGS. 7 and 8, the hub is held on an end of the drive shaft 50 by a mixing blade 150 instead of a cap. The simplest design of the mixing blade 150 is a flat bar of some thickness. The flat bar only partially covers the ports. This acts as a flat blade propeller driving the stock away from the disc eye into the outer set of refiner plates. This mixing blade may be modified with two or more added blades (as shown in ghost in FIG. 7); either flats or swept to further enhance flow distribution from the cross flow ports. They will also enhance the flow through the hub by creating a larger differential pressure across the hub. In other embodiments, the blades can be omitted.

FIG. 8 is a fragmentary partly longitudinal vertical sectional view similar to FIG. 7, only showing an alternate hub 160 and mixing blade 164 construction. In this construction, the outside diameter of the hub 160 is narrower in the axial direction than the central portion of the hub 102 in order to further improve flow of stock into the flow paths between the discs. And in this embodiment, the mixing blade 104 has added extensions 168 facing the hub 160.

The significant change that this invention provides over the prior art is in the location of the cross flow portholes 136 into the hub. These portholes 136 are designed fewer in number to reduce flow friction losses. Cross flow areas are equal to or exceed conventional porting, and the mixing blade 150 is now positioned to influence the flow.

Various other features and advantages of the invention will be apparent from the following claims.

The invention claimed is:

1. A refiner for pulp or like materials, comprising a housing having a chamber, a material-admitting inlet and an outlet; spaced apart first and second refining members mounted in said chamber; a rotary third refining member disposed in said chamber between said first and second refining members, said third refining member having a central opening and wherein said third refining member does not have cross flow ports, said refining members being coaxial with each other, a first path for the movement of material from the inlet is defined between the first and third refining members, a second path for the movement of material to the outlet is defined between the second and third refining members, said first and second refining members respectively having first and second comminuting projections adjacent to said first and second path and said third refining member having third and fourth comminuting projections adjacent to said first and second path and respectively cooperating with said first and second projections to refine the material flowing along said first and second paths, means for rotating said third refining member and comprising a shaft extending through a central opening provided in said first refining member, a hub rigid with said shaft and having a center, said hub being received in said third refining member central opening so that said third refining member is movable axially of said hub, and said hub having at least one port in said hub from said first path to said second path and between said third refining member central opening and said center of said hub, and means for transmitting torque from said hub to said third refining member, said torque transmitting means comprising said hub having a splined exterior, and said third refining member central opening having splines that engage said hub splined exterior.

2. A refiner as defined in claim 1, wherein said comminuting projection on all refining members is blades integral with its respective refining member.

3. A refiner as defined in claim 1, wherein said hub is held on an end of said shaft by a mixing blade that partially covers said port.

4. A refiner as defined in claim 1, wherein said third refining member comprises a central support having said central opening, and a first plate on one side of said central support and a second plate on the opposite side of said central support.

5. A refiner as defined in claim 1, wherein said hub has at least two ports in said hub.

6. A refiner for pulp or like material, comprising a housing having a chamber, a material-admitting inlet and an outlet; spaced apart first and second refining members mounted in said chamber; a rotary third refining member disposed in said chamber between said first and second refining members, said third refining member having a central opening and wherein said third refining member does not have cross flow ports, said refining members being coaxial with each other, a first path for the movement of material from the inlet is defined between the first and third refining members, a second path for the movement of material to the outlet is defined between the second and third refining members, said first and second refining members respectively having first and second comminuting projections adjacent to said first and second path and said third refining member having third and fourth comminuting projections adjacent to said first and second path and respectively cooperating with said first and second projections to refine the material flowing along said first and second paths, means for rotating said third refining member and comprising a shaft extending through a central opening provided in said first refining member, a hub rigid with said shaft and having a center and a splined exterior, said hub being received in said third refining member central opening, and said hub having at least one port in said hub from said first path to said second path and between said third refining member central opening and said center of said hub, and means for transmitting torque from said hub to said third refining member, said torque transmitting means comprising splines on said hub outer surface, and said third refining member central opening having splines that engage said hub splined exterior, and said third refining member being movable axially of said hub.

7. A refiner as defined in claim 6, wherein said hub is held on an end of said shaft by a mixing blade that partially covers said port.

8. A refiner as defined in claim 6, wherein said third refining member comprises a central support having said central opening, and a first plate on one side of said central support and a second plate on the opposite side of said central support.

9. A refiner as defined in claim 6, wherein said hub has at least two ports in said hub.

10. An assembly comprising a hub and a rotary third refining member adapted to be used in a refiner for pulp or like materials, the refiner comprising a housing having a chamber, a material-admitting inlet and an outlet; spaced apart first and second refining members mounted in said chamber; the rotary third refining member being adapted to be disposed in said chamber between said first and second refining members, said third refining member having a central opening and wherein said third refining member does not have cross flow ports, said refining members being coaxial with each other, a first path for the movement of material from the inlet is defined between the first and third refining members, a second path for the movement of material to the outlet is defined between the second and third refining members, said first and second refining members respectively having first and second comminuting projections adjacent to said first and second path and said third refining member having third and fourth comminuting projections adapted to be adjacent to said first and second path and respectively cooperating with said first and second projections to refine the material flowing along said first and second paths, said refiner further having means adapted to rotate said third refining member and comprising a shaft extending through a central opening provided in said first refining member, and said hub is adapted to be rigidly connected to said shaft, said hub having a center, said hub being received in said third refining member central opening so that said third refining member is movable axially of said hub, and said hub having at least one port in said hub from said first path to said second path and between said third refining member central opening and said center of said hub, and means for transmitting torque from said hub to said third refining member, said torque transmitting means comprising said hub having a splined exterior, and said third refining member central opening having splines that engage said hub splined exterior.

11. An assembly as defined in claim 10, wherein said third refining member comprises a central support having said central opening, and a first plate on one side of said central support and a second plate on the opposite side of said central support.

12. An assembly as defined in claim 10, wherein said hub has at least two ports in said hub.

* * * * *